US005449277A

United States Patent [19]

Hood

[11] Patent Number: 5,449,277

[45] Date of Patent: Sep. 12, 1995

[54] APPARATUS FOR PACKAGING A COMPRESSOR

[75] Inventor: James A. Hood, Concord, N.C.

[73] Assignee: Ingersoll-Rand Company, Woodcliff Lake, N.J.

[21] Appl. No.: 196,535

[22] Filed: Feb. 15, 1994

[51] Int. Cl.[6] ..... F04B 37/02

[52] U.S. Cl. ..... 417/362; 417/540

[58] Field of Search ..... 417/362, 540, 53; 418/201.1

[56] References Cited

U.S. PATENT DOCUMENTS

| | | | |
|---|---|---|---|
| 3,008,422 | 11/1961 | Crisafulli . | |
| 3,053,490 | 9/1962 | Weeks . | |
| 3,132,596 | 5/1964 | Dinger . | |
| 4,768,930 | 9/1988 | Grime et al. . | |
| 5,199,858 | 4/1993 | Tsuboi et al. | 417/362 |
| 5,269,662 | 12/1993 | Denton et al. | 417/362 X |

*Primary Examiner*—Richard E. Gluck
*Attorney, Agent, or Firm*—Victor M. Genco, Jr.

[57] ABSTRACT

An apparatus is provided for packaging an air compressor. The air compressor includes a rotary-screw airend which is belt driven by a prime mover, such as an electric motor. A drive shaft of the airend is rotatable about a first axis. A compressed air receiving tank receives compressed air. First and second mounting brackets are made integral with the airend, and pivotally mount the airend on a frame. The airend is pivotally moveable about a second axis which is laterally offset to the first axis. The second mounting bracket defines an interior cavity which fluidly communicates with the discharge portion of the airend. A discharge pipe mounting means mounts a discharge pipe in fluid communication with the interior cavity and in collinear relation with the second axis. A rigid pipe is mountingly received by the discharge pipe mounting means and fluidly connects the airend with the compressed air receiving tank.

6 Claims, 1 Drawing Sheet

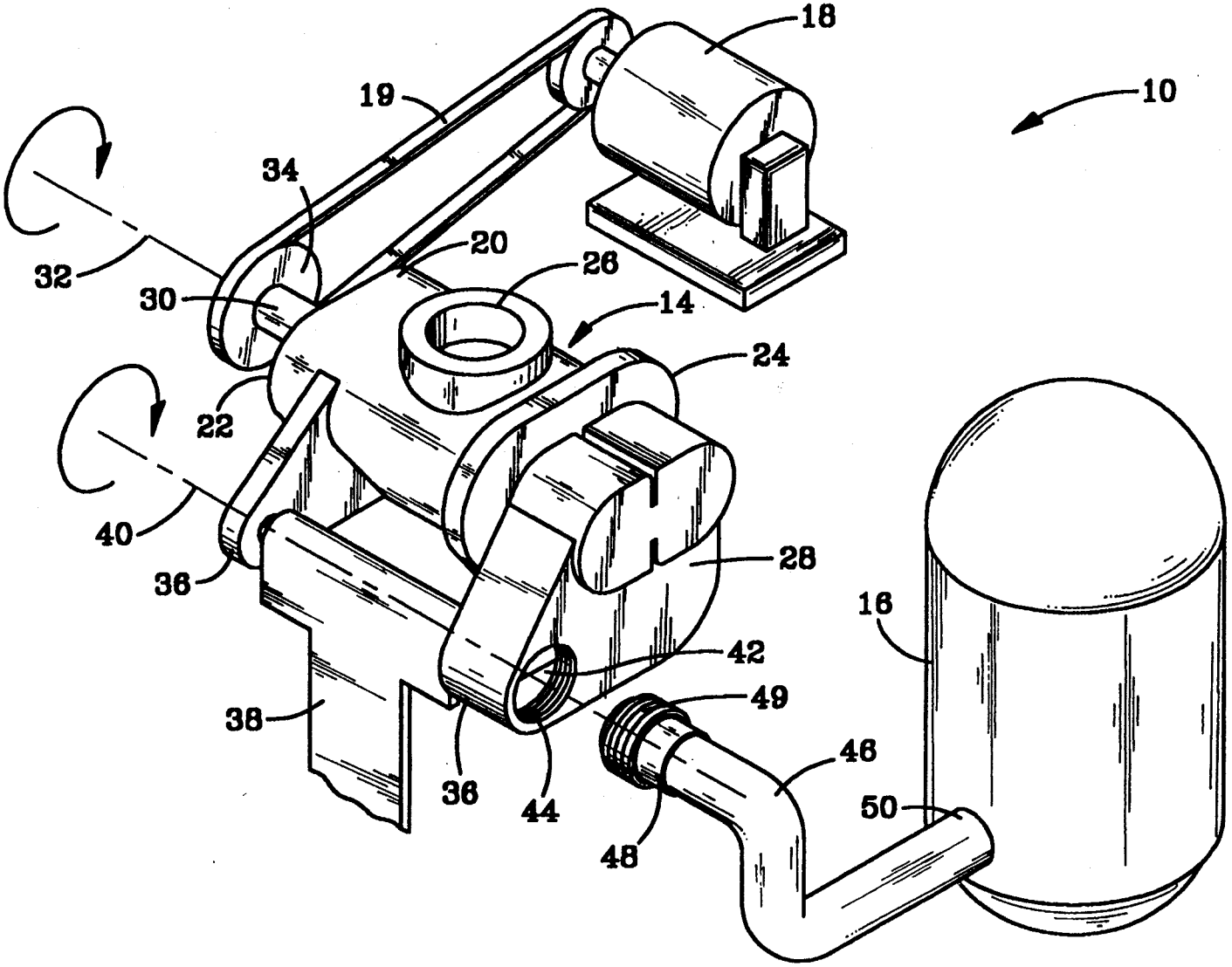
10
18
19
20
26
14
24
28
42
49
46
50
16
48
44
36
38
34
30
22
36
40
32

APPARATUS FOR PACKAGING A COMPRESSOR

BACKGROUND OF THE INVENTION

This invention generally relates to fluid compressors, and more particularly to an apparatus for mounting and packaging an airend of a rotary screw air compressor.

Typically, portable and stationary air compressor packages include a belt-driven airend (i.e. the air compressing portion of the compressor package), an air receiving tank which is coupled in fluid communication to the airend by rigid piping, and a compressor prime mover for driving the belt-driven airend, such as an electric motor or an engine. In these compressor packages, it has been discovered that it is advantageous to configure the compressor package such that the airend is moveable relative to the compressor prime mover, which thereby permits proper tensioning of the compressor drive belts.

As one may expect, it is difficult, if not impractical, for the rigid piping to accommodate the movement of the airend relative to the compressor prime mover. Accordingly, to date, in compressor packages which permit airend movement to provide proper belt tensioning, flexible piping has been employed between the airend and the receiving tank, instead of rigid piping. This flexible piping has included flexible hoses and convoluted steel tubing. However, flexible piping is prone to fatigue and deterioration, which presents a greater risk of failure of the flexible piping during air compressor use, as compared with the rigid piping.

The foregoing illustrates various limitations known to exist in present air compressor package designs. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an air compressor which includes a rotary-screw airend having first and second rotors which matingly intermesh to compress a predetermined volume of air. The airend includes a housing having first and second ends, an intake portion and a compressed air discharge portion. A drive shaft is rotatable about a first axis and is mounted in driving relation with the rotors. The drive shaft mounts a drive pulley. A compressed air receiving tank is provided to receive a predetermined volume of compressed air. A prime mover, such as an electric motor or an engine, drives a belt which is received by the drive shaft pulley. An airend mounting device pivotally mounts the airend on a frame. The airend is pivotally moveable about a second axis which is laterally offset to the first axis. The airend mounting device defines an interior cavity which fluidly communicates with the discharge portion of the airend. A discharge pipe mounting device mounts a first end of a discharge pipe in fluid communication with the interior cavity and in collinear relation with the second axis. The second end of the discharge pipe is fluidly connected with the compressed air receiving tank.

The foregoing and other aspects will become apparent from the following detailed description of the invention when considered in conjunction with the accompanying drawing figures.

BRIEF DESCRIPTION OF THE DRAWING FIGURES

The FIGURE is a partial, environmental representation of the apparatus of the present invention which is illustrated in combination with an air compressor package having a rotary screw airend.

DETAILED DESCRIPTION

Referring now to the FIGURE, the apparatus of the present invention is illustrated generally at 10, and is illustrated in combination with a rotary-screw air compressor which includes a rotary-screw airend 14, a compressed air receiving tank 16, and a prime mover 18, such as an electric motor. The term rotary-screw compressor, as used herein, applies to rotary-screw pumps and rotary-screw compressors, as well as any rotary-screw device which displaces a working fluid by rotary screw action. A working fluid, as used herein, is intended to include any fluid, including gases, such as air. Airend is intended to mean the working or fluid compressing portion of a rotary-screw compressor. In this specification, the term "prime mover" is intended to cover diesel engines as well as other internal combustion engines, turbines, and electric motors, or any device which provides a motive force to the airend 14.

The airend 14 includes first and second helical rotors (not shown) which matingly intermesh to compress the working fluid. The first and second helical rotors are mounted for operation within an airend housing 20. The housing 20 includes first and second ends 22 and 24, respectively, an intake portion 26 and a compressed air discharge portion 28, through which compressed air exits the airend 14.

A drive shaft 30 is rotatable about a first axis 32. The drive shaft is mounted in driving relation with a predetermined rotor, as is well known in the art. The drive shaft 30 mounts a pulley 34 which is disposed in force receiving relation to the prime mover 18. More particularly, and as illustrated in the FIGURE, the prime mover 18 is an electric motor which drives a belt 19 which is disposed in force transmitting relation to the drive shaft pulley 34.

An airend mounting apparatus 36 pivotally mounts the airend on a frame structure 38. The airend mounting apparatus 36 may be any suitable means for pivotally mounting the airend 14 on the frame structure 38. For example, and as illustrated in the FIGURE, the airend mounting apparatus may include a first mounting bracket which is made integral with the airend housing 20 at the first end 22, and a second mounting bracket which is made integral with the airend housing at the second end 24. The brackets may pivotally mount the airend 14 on the frame structure 38 by a conventional pin and detent arrangement, for example. As should be understood, once the airend 14 has been mounted on the frame 38, the airend is moveable about a second axis 40, which is laterally offset to the first axis 32. An airend positioning device (not shown) fixedly locates the airend 14 in a desired location about the axis 40. The airend positioning device may be any suitable means such as a threaded fastener, for example. In the preferred embodiment, the second mounting bracket defines an interior cavity 42 which fluidly communicates with the discharge portion of the airend 14. Additionally and in the preferred embodiment, the second mounting bracket defines a discharge aperture 44, which may be a threaded aperture.

As is well known in the art, at times, gas pulsations may be generated by a rotary-screw compressor during its operation. These gas pulsations exit the rotary-screw compressor airend 14 at the discharge portion of the housing 20. In the preferred embodiment of the present invention, the interior cavity 42 defines a predetermined volume which is sufficient to dampen the magnitude of any gas pulsation which may be produced by the airend 14.

A rigid discharge pipe 46 fluidly connects the interior cavity 42 of the second mounting bracket with the compressed air receiving tank 16, which may be a conventional compressed air separator tank. The rigid discharge pipe 46 includes first and second ends, 48 and 50, respectively. The first end 48 is mountingly received by the discharge aperture 44 in collinear relation to the axis 40. Although any suitable mounting means may be employed to mount the rigid discharge pipe to the discharge aperture, a preferred embodiment of a discharge pipe mounting means is illustrated as a conventional threaded swivel joint 49 which engages a suitably threaded discharge aperture 44. The swivel joint 49 mounts the rigid discharge pipe 46 to the second mounting bracket, and permits the rigid discharge pipe to remain stationary, relative to the airend 14, at times when the airend is pivoted about the axis 40. The second end of the rigid discharge pipe is suitably fluidly connected to the compressed air receiving tank 16.

The apparatus of the present invention facilitates the packaging of a rotary screw compressor. In operation, the airend mounting apparatus 36, i.e. the first and second mounting brackets, pivotally mount the airend 14 to the frame 38. The first end 48 of the rigid pipe 46 is connected to the compressed air discharge portion of the airend housing 20 in collinear relation with the second axis 40. The second end 50 of the rigid pipe is connected to the compressed air receiving tank 16. Once mounted on the frame 38, the apparatus 10 permits the airend 14 to be pivoted about the second axis 40, which is laterally offset from the first axis 32, to thereby tension the belt 19. The airend positioning device fixedly locates the airend 14 in the belt tensioning location about the axis 40. During tensioning of the belt 19 by pivotal movement of the airend 14, the first end 48 of the rigid pipe 46 remains stationary, by action of the swivel joint 49, relative to the pivoting airend 14.

While this invention has been illustrated and described in accordance with a preferred embodiment, it is recognized that variations and changes may be made therein without departing from the invention as set forth in the following claims.

Having described the invention, what is claimed is:

1. An air compressor comprising:

a rotary-screw airend having intermeshing rotors which compress a predetermined volume of air, the airend including a housing having first and second ends, an intake portion and a compressed air discharge portion;

a drive shaft rotatable about a first axis mounted in driving relation with the rotors, the drive shaft mounting a pulley;

a compressed air receiving tank;

belt drive means for driving a belt which is received by the drive shaft pulley;

a frame;

airend mounting means for pivotally mounting the airend on the frame, the airend being pivotally moveable about a second axis which is laterally offset to the first axis, the airend mounting means defining an interior cavity which fluidly communicates with the discharge portion of the airend;

discharge pipe mounting means for mounting a discharge pipe in fluid communication with the interior cavity and in collinear relation with the second axis; and a rigid discharge pipe having first and second ends, the first end being mountingly received by the discharge pipe mounting means and the second end fluidly communicating with the compressed air receiving tank.

2. An air compressor as claimed in claim 1, and wherein the airend mounting means comprises first and second mounting brackets.

3. An air compressor as claimed in claim 1, and wherein the interior cavity of the airend mounting means defines a predetermined volume which is sufficient to dampen the magnitude of a gas pulsation produced by the airend.

4. In combination with an air compressor having a rotary-screw airend, drive shaft means for driving the airend and for mounting a drive pulley which is rotatable about a first axis, a compressed air receiving tank for receiving the compressed air, a belt drive means for driving a belt which is received by the drive pulley, and a frame which mounts the airend, the airend having a housing, an intake portion and a compressed air discharge portion, an apparatus for packaging the air compressor comprising:

first and second mounting brackets made integral with the airend and pivotally mounting the airend on the frame, the airend being pivotally moveable about a second axis which is laterally offset to the first axis, the second mounting bracket defining an interior cavity which fluidly communicates with the discharge portion of the airend;

discharge pipe mounting means for mounting a discharge pipe in fluid communication with the interior cavity and in collinear relation with-the second axis; and a rigid pipe having first and second ends, the first end being mountingly received by the discharge pipe mounting means and the second end fluidly communicating with the compressed air receiving tank.

5. In an air compressor package having a rotary-screw airend, a drive shaft means for driving the airend and for mounting a drive pulley which is rotatable about a first axis, a compressed air receiving tank, a belt drive means for driving a belt which is received by the drive pulley, and a frame which mounts the airend, the airend having a housing, an intake portion and a compressed air discharge portion, a method for packaging the air compressor comprising the following steps:

fixedly attaching a mounting bracket on the airend;

mounting the airend on the frame such that the airend is pivotally moveable about a second axis which is laterally offset to the first axis; and fluidly connecting a first end of a rigid pipe to the compressed air discharge portion of the airend housing in collinear relation with the second axis, and fluidly connecting a second end of the rigid pipe to the compressed air receiving tank.

6. In combination with a rotary-screw air compressor having a rotary-screw airend, drive shaft means for driving the airend and for mounting a drive pulley which is rotatable about a first axis, a belt drive means for driving a belt which is received by the drive pulley, and a frame which mounts the airend, the airend having a housing, an intake portion and a compressed air discharge portion, an apparatus for packaging the air compressor comprising:

first and second mounting brackets made integral with the airend and pivotally mounting the airend on the frame, the airend being pivotally moveable about a second axis which is laterally offset to the first axis; and a rigid pipe having first and second ends, and wherein the first end is fluidly connected to the compressed air discharge portion of the airend housing in collinear relation to the second axis, and wherein the second end is connected to a compressed air receiving tank.

* * * * *